United States Patent [19]

Schultz et al.

[11] 3,994,622

[45] Nov. 30, 1976

[54] COOLABLE TURBINE BLADE

[75] Inventors: Paul Edwin Schultz, East Hampton; Gilbert Bardsley Wilcox, Somers, both of Conn.

[73] Assignee: United Technologies Corporation, Hartford, Conn.

[22] Filed: Nov. 24, 1975

[21] Appl. No.: 634,701

[52] U.S. Cl. ..... 416/97 R; 416/96 A

[51] Int. Cl.[2] ..... F01D 5/18

[58] Field of Search ..... 416/95–97, 416/96 A, 92

[56] References Cited

UNITED STATES PATENTS

| | | | |
|---|---|---|---|
| 3,388,888 | 6/1968 | Kercher et al. | 416/96 A X |
| 3,533,712 | 10/1970 | Kercher | 416/96 X |
| 3,628,885 | 12/1971 | Sidenstick et al. | 416/95 X |
| 3,700,348 | 10/1972 | Corsmeier et al. | 416/95 X |
| 3,715,170 | 2/1973 | Savage et al. | 416/97 |
| 3,846,041 | 11/1974 | Albani | 416/97 |
| 3,867,068 | 2/1975 | Corsmeier et al. | 416/97 |
| 3,899,267 | 8/1975 | Dennis et al. | 416/96 X |
| 3,902,820 | 9/1975 | Amos | 416/97 |

*Primary Examiner*—Everette A. Powell, Jr.
*Attorney, Agent, or Firm*—Robert C. Walker

[57] ABSTRACT

A rotor blade capable of use in the high temperature environment of the turbine section of a gas turbine engine is disclosed. Various construction details which tend to equalize the metal temperature of the blade during operation also improve the cooling effectiveness of the cooling medium utilized. The system is built around convective, impingement, and film cooling techniques which are employed singly or in combination to improve the service life of the blade.

4 Claims, 7 Drawing Figures

64
66

60
40
47
62
58
50
20
30
44
60
46
60
50
48
48
38

34
36
5
5
7
7
6
6
38
30
50
10
12
2
2
26
20
32
40
42
50
28
58
52
48
60
16
14
18
56
24
22
4
4
3
3

A

B 24
22

24
54

COOLABLE TURBINE BLADE

BACKGROUND OF THE INVENTION

1. Field of the Invention

This invention relates to turbine machines and particularly to coolable rotor blades in turbine machines.

2. Description of the Prior Art

A gas turbine engine is typical of turbine machines in which the concepts described herein may be advantageously employed. In a gas turbine engine pressurized air and fuel are burned in a combustion chamber to add thermal energy to the medium gases flowing therethrough. The effluent from the chamber comprises high temperature gases which are flowed downstream in an annular flow path through the turbine section of the engine. Nozzle guide vanes at the inlet to the turbine direct the medium gases onto a multiplicity of rotor blades which extend radially outward from the engine rotor. The nozzle guide vanes and rotor blades are particularly susceptible to thermal damage and are commonly cooled to control the temperature of the material comprising the components in anticipation of high effluent temperatures. Cooling air from the engine compressor is bled through suitable conduit means to the turbine for subsequent distribution to the rotor blades and guide vanes.

Thermal degradation of the component material due to excessive temperatures is one principal problem which heretofore has adversely limited the service life of turbine rotor blades. In the shank portion degradation due to creep phenomenon is of primary concern as elongation of the blade shank initially alters the radial position of the blade and may ultimately result in fracture. Control of the shank material temperature is required to limit elongation and to prevent creep from becoming a seriously limiting factor in rotor blade service life. The airfoil portion of each blade is similarly susceptible to creep although the centrifugally generated forces decrease in the radial direction outwardly to the blade tip. Additionally, the airfoil portion of each blade is highly susceptible to erosion as the local surface temperature of the blade approach the melting point of the component material.

The service life of rotor blades is also adversely limited by thermal fatigue. Thermal fatigue results from the mechanical effect of repeated thermal stresses occurring during nonuniform expansion of the various regions of the blade. Repeated thermal cycling precipitates substantial stress excursions and results in ultimate failure of the component. Control of the thermal gradients which produce stress excursions is required to mitigate the harmful effects of changing thermal environments.

Continuing efforts are underway to improve the service life of turbine rotor blades by limiting the temperature of the component material in the various regions of each blade and by reducing the thermal gradients across each blade.

SUMMARY OF THE INVENTION

A primary aim of the present invention is to improve the service life of a rotor blade used in the turbine section of a turbine machine. Improved cooling effectiveness and reduced thermal gradients are sought. In one embodiment a specific object is to reduce the temperature of the blade material at the tip of the airfoil section. Temperature control at the shank region and at the leading edge of the airfoil section are concurrent goals.

According to the present invention a coolable turbine blade having a hollow cavity is internally compartmentalized by a turbular insert forming a leading edge chamber from which cooling air is flowable to the exterior surface of the leading edge of the blade for film cooling, and forming a shank passage between the insert and the blade shank through which cooling air is flowable to convectively cool the shank region of the blade; the insert further distributes impingement cooling air over the interior surfaces of the hollow cavity and air to tip passages disposed in a chord-wise pattern near the tip of the blade.

A primary feature of the present invention is the tip passages which, in one embodiment, are disposed in a chord-wise pattern on the pressure side of the airfoil section at the tip region. The tubular insert provides a conduit for the flow of cooling air to the tip region while structurally forming the leading edge chamber and the shank passage. Cooling air is flowable to the shank passage through grooves fabricated in the flared receptacle of the root. Impingement cooling air is flowable from the insert against the interior walls of the airfoil cavity to lower the blade metal temperature. Film cooling air is flowable from the leading edge chamber and over the exterior surface of the leading edge to isolate the rotor blade material from the hot working medium gases of the flow path.

A primary advantage of the present invention is improved cooling effectiveness implemented by isolating the film cooling holes of the leading edge from the remainder of the cavity to ensure a positive distribution of cooling air to the leading edge holes. Radical temperature gradients across the blade are eliminated by controlling the local temperatures in the various regions of the blade. The service life of the blade is improved by reducing the susceptibility of the blade material to creep or erosion. The adverse effects of thermal gradients on the thermal fatigue life of the blade are mitigated by a reduction in the strength of the gradients imposed.

The foregoing, and other objects, features and advantages of the present invention will become more apparent in the light of the following detailed description of the preferred embodiment thereof as shown in the accompanying drawing.

DESCRIPTION OF THE PREFERRED EMBODIMENTS

Figures 1, 2, 3, 4, 5, 6, 7:
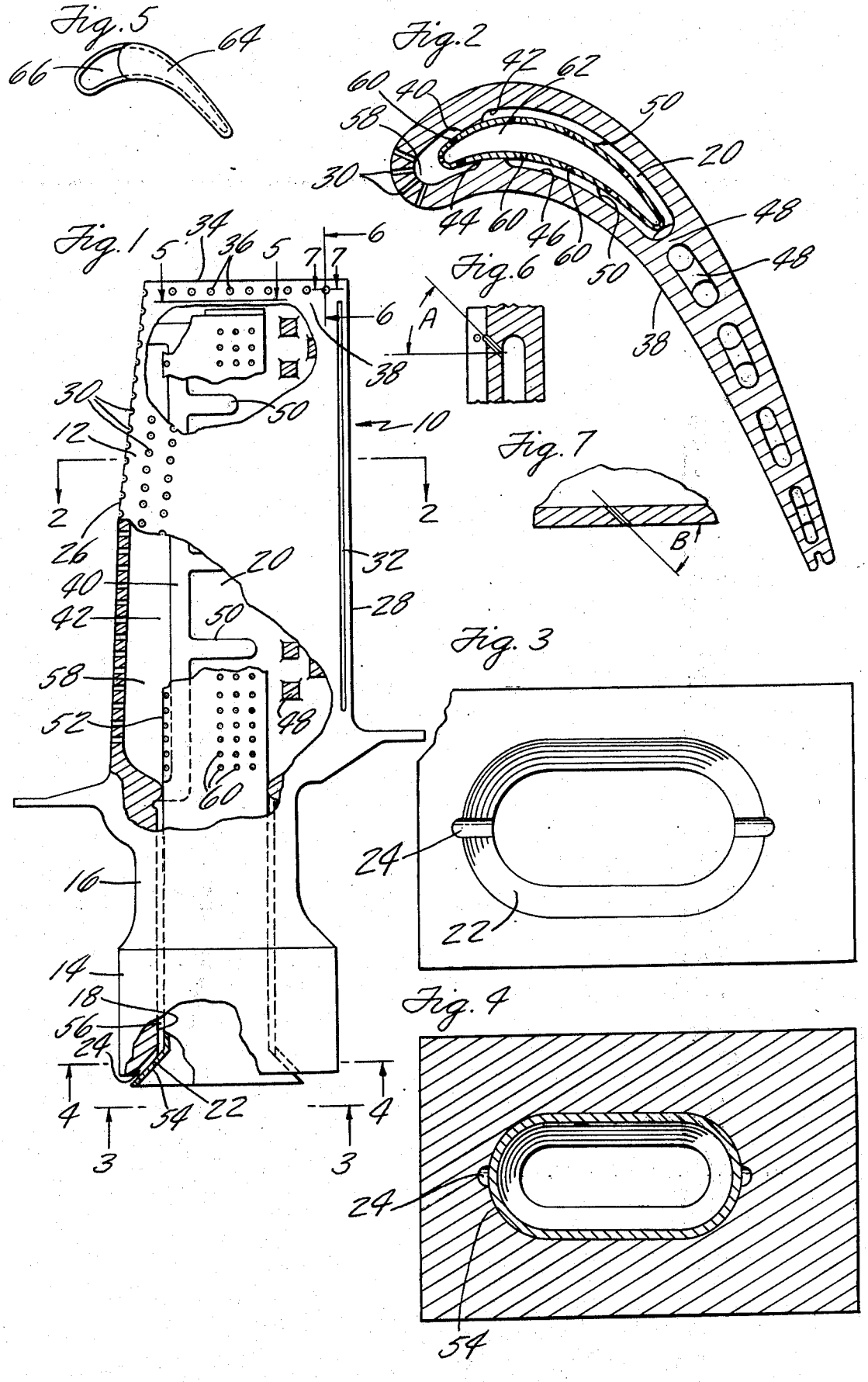
FIG. 1 is a side elevation view of a turbine blade with portions broken away to reveal the internal configuration of the blade.
FIG. 2 is an enlarged sectional view taken along the line 2—2 as shown in FIG. 1.
FIG. 3 is an enlarged end view of the blade root with the tubular insert removed taken in the direction 3—3.
FIG. 4 is an enlarged sectional view with the tubular insert in place taken along the line 2—2 as shown in FIG. 1.
FIG. 5 is a top view of the tubular insert taken in the direction 5—5 as shown in FIG. 1.
FIG. 6 is a sectional view taken along the line 6—6 as shown in FIG. 1 which reveals the angular relationship of the blade tip holes in one embodiment.
FIG. 7 is a sectional view taken along the line 7—7 as shown in FIG. 1 which further shows the angular relationship of the blade tip cooling holes in one embodiment.

A rotor blade 10 which is suitable for use in the turbine section of a gas turbine engine is shown in FIG. 1. The blade has as principal regions an airfoil 12, a root 14, and a shank 16 which extends radially between the root and the airfoil. The shank has a central conduit 18 which is communicatively joined to a hollow cavity 20 of the airfoil. The root has a flared receptacle 22 including at least one groove 24 incorporated therein. The airfoil has a leading edge 26 facing in the upstream direction with respect to approaching flow and a trailing edge 28 facing in the downstream direction. A multiplicity of flow emitting holes 30 and a spanwise extending slot 32 are incorporated in the leading and trailing edges respectively. The airfoil has a tip 34 which is opposed, as installed in an engine, by an outer shroud not shown. A plurality of tip passages 36 are disposed in the pressure side surface 38 of the airfoil in the tip region.

The hollow cavity 20 of the airfoil has incorporated therein a spanwise extending sealing rib 40 projecting from the suction side wall 42 of the cavity. A second sealing rib 44 projects from the pressure side wall 46 as is viewable in FIG. 2. A plurality of turbulators 48 join the pressure and suction walls in the trailing edge region. Spacers 50 project from both the suction and pressure walls to isolate regions of the walls and to space a tubular insert 52 from said walls.

The tubular insert 52 is disposed within the hollow cavity 20 and is anchored at the root of the blade by a flared flange 54 which engages the flared receptacle 22 of the root. The installed insert is spaced apart from the walls of the shank conduit 18 to form a cooling passage 56 therebetween. The insert abuts the sealing ribs 40 and 44 to form a distinct leading edge chamber 58 within the hollow cavity 20. A multiplicity of impingement orifices 60 are disposed through the walls of the insert to direct cooling air from the central portion 62 of the insert against the pressure wall 46 and the suction wall 42 of the hollow cavity 20 during operation of the engine.

As is shown in FIG. 5, the tip of the tubular insert 52 is partially closed by a tip baffle 64. The open portion 66 of the tip provides gas communication between the central portion 62 of the insert and the passages 36 of the blade.

Some specific problems which must be overcome in the design of rotor blades for turbine machines are discussed in the prior art section of this specification. Each problem discussed is effectively lessened by the apparatus described herein through the application of varied cooling techniques. The cooling techniques employed have been selected for judicious allotment and reuse of available cooling capacity to meet the peculiar cooling requirements of each region of the blade.

The shank 16 of the blade extends from the root 14 to the airfoil 12. During operation of the engine the shank is held in tension by strong centrifugal forces impelling the blade radially outward. The tendency of the shank to elongate as a result of creep phenomenon is controlled herein by limiting the temperature of the shank material. For most conventional materials used in the fabrication of turbine blades a limiting temperature on the order of 1300° to 1400° Fahrenheit is selected. Convection cooling techniques are employed in the shank region shown to insure operation below the limiting temperature.

Cooling air is flowed through the grooves 24 to the shank passage 56 and ultimately to the hollow cavity 20 of the airfoil. Heat from the shank is evenly absorbed by the cooling air passing therethrough without establishing severe thermal gradients across the shank. The size and the number of the grooves 24 formed in the flared receptacle 22 of the root is varied according to the cooling requirements of each individual blade. In the construction shown two grooves are utilized to provide an even flow of cooling air to the shank passage 56 to reduce the strength of thermal gradients.

The leading edge 26 of the airfoil section is exposed to the harshest thermal environment and is principally cooled by film cooling techniques. Film cooling requires a precise pressure drop across the flow emitting holes 30 at the leading edge. If the pressure drop is too great the emitted flow penetrates the passing working medium and is deflected downstream with the medium gases without establishing a film layer on the airfoil surface. On the other hand if the pressure drop is too small, the medium gases penetrate the cooling air layer and destructive heating of the component material results. The holes 30 of the leading edge are isolated from the remainder of the cavity by the sealing ribs 40 and 44 which abut the insert 20 to form the chamber 58. Cooling air is flowed to the chamber 58 from the central portion 62 of the insert through the orifices 60 in that region. Because the chamber 58 is isolated from the downstream portion of the blade, the cooling air flows from the chamber 58 to the holes 30 rather than axially rearward to a region of lower pressure through the cavity 20 and out through the slot 32 in the trailing edge. The holes 30 of the leading edge and the orifices 60 of the insert in the leading edge region are sized to provide a precise flow of cooling air over the leading edge of the blade.

The interior walls of the cavity 20 are cooled primarily by impingement techniques although some cooling results from convective and film techniques in the area. Cooling air is flowed to the central portion 62 of the insert 52 and is accelerated across the orifices 60 to a velocity which causes the flow to impinge locally upon the opposing interior walls of the cavity 20. In the regions of local impingement the rates of heat transfer are increased and more effective utilization of the cooling air is made.

The tip 34 of each blade is opposed by a circumferential outer air seal which is not shown in the drawing. The clearance between the blade tip and the shroud is relatively small and substantial turbulence is generated therebetween. A high rate of heat transfer between the working medium gases and the blade tip material in the turbulent region necessitates blade tip cooling which is provided in the embodiment shown by the tip passages 36. A positive flow of cooling air to the tip holes 36 is directed to the region by the insert 52 which has an open portion 66 in the end thereof. During operation of the engine cooling air flows radially through the tubular insert 52 and through the opening 66 to the tip cooling holes. The holes, which are oriented in a chord-wise pattern, are disposed in the pressure side surface of the blade so as to cause the air flowed therefrom to be carried radially outward and over the tip of the blade. As is viewable in FIGS. 6 and 7 the cooling holes 36 are canted rearwardly and outwardly with respect to the machine in which the blade is mounted. In one construction holes which are canted rearwardly to an angle (B) of 45° and outwardly to an angle (A) of 60° have been shown to provide particularly effective cooling of the tip.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention, that which we claim as new and desire to secure by Letters Patent of the United States is:

1. A coolable turbine blade assembly for a gas turbine engine, comprising:

a blade including as principal sections a root having a flared receptacle with at least one groove incorporated in the flared receptacle, a shank extending from the root and having a central conduit contained therein which extends from the flared receptacle of the root, and an airfoil extending from the shank and having a hollow cavity formed between interior walls wherein the cavity is communicatively joined to the central conduit of the shank and wherein the airfoil has external features including a leading edge facing in the upstream direction with respect to approaching flow and a trailing edge facing in the downstream direction, a multiplicity of film cooling holes disposed in the leading edge and a slot disposed in the trailing edge, and a tip having a plurality of tip cooling passages disposed in the chord-wise direction across the airfoil and wherein the airfoil has internal features including a pair of sealing ribs which extend from the interior walls of the cavity one on each side of the leading edge hole, a plurality of pedestals joining the interior walls at the trailing edge, and spacers projecting from the interior walls of the cavities to isolate regions of the walls; and a tubular insert extending through the central conduit of said shank, forming a shank passage between the insert and the wall of the central conduit, and into the hollow cavity of said airfoil where the insert abuts said pair of sealing ribs to form a leading edge chamber adjacent to said film cooling holes and wherein the insert has a multiplicity of impingement orifices disposed therein which communicatively join the central portion of the insert to the leading edge chamber, and a tip which is partially closed by a tip baffle, the open portion of the tip communicatively joining the central portion of the insert and said tip cooling passages of the airfoil.

2. The invention according to claim 1 wherein said tip passages are disposed in the pressure side surface of the airfoil.

3. The invention according to claim 2 wherein said tip passages are canted outwardly and rearwardly with respect to an installed turbine blade.

4. The invention according to claim 3 wherein said tip passages are canted outwardly at an angle of approximately 60° and rearwardly at an angle of approximately 45° with respect to an installed turbine blade.

* * * * *